US008996389B2

(12) United States Patent
Elias

(10) Patent No.: US 8,996,389 B2
(45) Date of Patent: Mar. 31, 2015

(54) ARTIFACT REDUCTION IN TIME COMPRESSION

(75) Inventor: Eric David Elias, Brookline, MA (US)

(73) Assignee: Polycom, Inc., San Jose, CA (US)

( * ) Notice: Subject to any disclaimer, the term of this patent is extended or adjusted under 35 U.S.C. 154(b) by 919 days.

(21) Appl. No.: 13/159,815

(22) Filed: Jun. 14, 2011

(65) Prior Publication Data

US 2012/0323585 A1 Dec. 20, 2012

(51) Int. Cl.

| | |
|---|---|
| ***G10L 25/00*** | (2013.01) |
| ***G10L 21/00*** | (2013.01) |
| ***G10L 19/00*** | (2013.01) |
| ***G10L 19/022*** | (2013.01) |
| ***G10L 21/04*** | (2013.01) |
| ***G10L 25/93*** | (2013.01) |

(52) U.S. Cl.

CPC ..... *G10L 19/022* (2013.01); *G10L 21/04* (2013.01); *G10L 25/93* (2013.01)

USPC ..... 704/504; 704/200; 704/211; 704/216; 704/214; 704/226; 704/500; 704/503

(58) Field of Classification Search

CPC ... G10L 21/04; G10L 21/057; G10L 21/0272; G10L 21/028; G10L 21/0308; G10L 2021/04; G10L 2021/057; G10L 25/00; G10L 25/7893; G10L 25/93; G10L 25/932; G10L 25/935; G10L 25/937; G10L 19/00; G10L 19/0017; G10L 19/0018; G10L 19/022

USPC ..... 704/200, 211, 216, 214, 226, 500, 503, 704/504; 375/345

See application file for complete search history.

(56) References Cited

U.S. PATENT DOCUMENTS

| | | | | | |
|---|---|---|---|---|---|
| 5,175,769 | A * | 12/1992 | Hejna et al. | ..... | 704/211 |
| 5,664,052 | A * | 9/1997 | Nishiguchi et al. | ..... | 704/214 |
| 5,806,023 | A * | 9/1998 | Satyamurti | ..... | 704/211 |
| 5,828,995 | A * | 10/1998 | Satyamurti et al. | ..... | 358/1.18 |
| 5,842,172 | A * | 11/1998 | Wilson | ..... | 704/503 |
| 6,226,605 | B1 * | 5/2001 | Nejime et al. | ..... | 704/207 |
| 6,718,309 | B1 * | 4/2004 | Selly | ..... | 704/503 |
| 6,728,678 | B2 * | 4/2004 | Bhadkamkar et al. | ..... | 704/270 |
| 6,963,833 | B1 * | 11/2005 | Singhal et al. | ..... | 704/207 |
| 7,065,485 | B1 * | 6/2006 | Chong-White et al. | ..... | 704/208 |
| 7,173,986 | B2 * | 2/2007 | Wu | ..... | 375/343 |
| 7,412,379 | B2 * | 8/2008 | Taori et al. | ..... | 704/214 |
| 7,792,681 | B2 * | 9/2010 | Covell et al. | ..... | 704/503 |
| 7,826,572 | B2 * | 11/2010 | Abbott et al. | ..... | 375/348 |
| 7,930,176 | B2 * | 4/2011 | Chen | ..... | 704/228 |
| 7,941,037 | B1 * | 5/2011 | Pereira | ..... | 386/339 |
| 8,078,456 | B2 * | 12/2011 | Chen et al. | ..... | 704/218 |
| 8,306,812 | B2 * | 11/2012 | Cho | ..... | 704/206 |

(Continued)

*Primary Examiner* — Paras D Shah

(74) *Attorney, Agent, or Firm* — Wong, Cabello, Lutsch, Rutherford & Brucculeri, L.L.P.

(57) ABSTRACT

Various techniques are disclosed for reducing artifacts generated by time compression. by adapting the time compression based on the state of the received audio. The amount of time compression may be bounded based on audio characteristics. Another feature provides a way of determining the most correlated portions of segments of audio. Voiced speech may be distinguished from unvoiced speech. Another feature provides a way of distinguishing between silence, voiced speech, and unvoiced speech. Time compression may be adapted during periods of lengthy silence. Another feature allows for reducing time compression during sensitive portions of the received audio. One or more of these features may be present in different embodiments.

19 Claims, 6 Drawing Sheets

(56) References Cited

U.S. PATENT DOCUMENTS

2005/0038534 A1* 2/2005 Sakurai et al. ..... 700/94
2005/0273321 A1* 12/2005 Choi ..... 704/207
2007/0168188 A1* 7/2007 Choi ..... 704/211
2007/0219778 A1* 9/2007 Whittaker et al. ..... 704/9
2007/0276657 A1* 11/2007 Gournay et al. ..... 704/203
2009/0171674 A1* 7/2009 Mitsumori ..... 704/500

* cited by examiner

ARTIFACT REDUCTION IN TIME COMPRESSION

TECHNICAL FIELD

The present invention relates to the field of conferencing systems, and in particular to a technique for reducing audio artifacts caused by time compression of audio playout.

BACKGROUND ART

Traditionally, IP-based voice and video conferencing systems have communicated over reliable enterprise networks that control for quality of service. In such networks, the most significant timing impairment comes from relative clock drifts in the end points. As users increasingly set up remote and home offices, however, conferencing systems are now connected over less reliable networks such as wireless and the public Internet. In such networks, timing impairments such as jitter and out of order packets are likely to occur with greater frequency and increased severity.

Consider the impairment of jitter. During a period of network congestion, packets may arrive at the conference system in large bursts. For audio, the passive solution is a deep buffer, which the system can fill from the network at a bursty rate. Meanwhile, the system plays the audio out of the buffer to the listener at a consistent smooth rate. This rate is equal to some desired play-out frame rate. While this solution is simple, the large buffer required has the downside of adding significant audio latency.

Conferencing systems have attempted to avoid the latency problem by using a time-compression algorithm to modify the speed of audio play out. Such algorithms use signal processing to shorten the duration of an audio signal without affecting pitch. When used to combat network jitter, a burst of many frames from the network is time compressed to reduce the number of frames to be played out to the listener.

Ideally, time-compression algorithms would create very natural sounding audio while handling the significant compression needed for network jitter. In fact, however, at high compression rates, these algorithms often result in audio artifacts. The two dominant artifacts that can be found in systems using existing algorithms can be described as sounding rough and sounding ghostly.

In some systems frequency domain techniques such as phase vocoders have been used. These techniques tend to have artifacts that could be described as having a ghostly sound. Time compression techniques have frequently generated rough sounding artifacts. Reducing these artifacts would improve the user's experience with conferencing systems.

BRIEF DESCRIPTION OF DRAWINGS

The accompanying drawings, which are incorporated in and constitute a part of this specification, illustrate an implementation of apparatus and methods consistent with the present invention and, together with the detailed description, serve to explain advantages and principles consistent with the invention. In the drawings.

DESCRIPTION OF EMBODIMENTS

Figure 1:
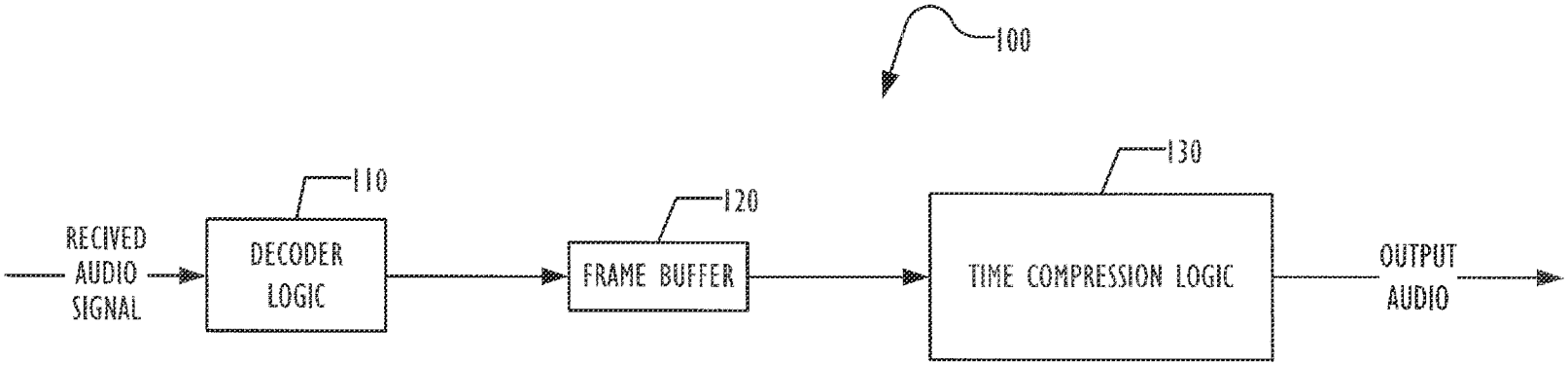
FIG. 1 is a block diagram illustrating a system for reducing artifacts in time-compressed audio according to one embodiment.

In the following description, for purposes of explanation, numerous specific details are set forth in order to provide a thorough understanding of the invention. It will be apparent, however, to one skilled in the art that the invention may be practiced without these specific details. In other instances, structure and devices are shown in block diagram form in order to avoid obscuring the invention. References to numbers without subscripts or suffixes are understood to reference all instance of subscripts and suffixes corresponding to the referenced number. Moreover, the language used in this disclosure has been principally selected for readability and instructional purposes, and may not have been selected to delineate or circumscribe the inventive subject matter, resort to the claims being necessary to determine such inventive subject matter. Reference in the specification to "one embodiment" or to "an embodiment" means that a particular feature, structure, or characteristic described in connection with the embodiments is included in at least one embodiment of the invention, and multiple references to "one embodiment" or "an embodiment" should not be understood as necessarily all referring to the same embodiment.

Various techniques are disclosed for improving time compression to reduce artifacts by adapting the time compression based on the state of the received audio. One feature of embodiments disclosed herein involves bounding the amount of time compression based on audio characteristics. Another feature provides a way of determining the most correlated portions of segments of audio. Another feature provides a way of distinguishing between voiced speech and unvoiced speech. Another feature provides a way of distinguishing between silence, voiced speech, and unvoiced speech. Another features provides adapts time compression during periods of lengthy silence. Another feature allows for reducing time compression during sensitive portions of the received audio. One or more of these features may be present in different embodiments.

In the following, the terms "packet" and "frame" are used interchangeably. A "sample" is a single scalar number representing an instantaneous moment of audio. A frame or packet is a sequence of samples representing a span of time in the audio, typically 10 msec. A "pitch period" of an audio signal is a measurement of the smallest repeating unit of the signal, and may also be referred to as a "pitch length" of the audio.

Embodiments described below make time compression techniques more adaptive to audio conditions. Although the description below is set forth in terms of speech-based audio, many of the techniques can be used with non-speech based audio. Other techniques may also be employed for the reduction of artifacts, such as the techniques described in U.S. patent application Ser. No. 12/911,314, "Artifact Reduction in Packet Loss Concealment," filed Oct. 25, 2010, which is incorporated by reference in its entirety for all purposes.

Although the techniques described below relate to time compression of audio, in various embodiments these techniques may be used where both audio and video signals are available and should be kept synchronized, such as in audio-video conferencing systems, where lip-synch errors between video of a speaker and the corresponding audio can lead to subconscious viewer stress and dislike of the conferencing experience.

FIG. 1 is a block diagram illustrating an apparatus 100 for performing time compression on a received audio signal. Other elements of the apparatus 100, such as elements that synchronize the audio signal with a video signal, are omitted for clarity. These omitted elements may be implemented in any convenient way, including as intervening elements between the elements illustrated in FIG. 1. As illustrated in FIG. 1, an audio signal is received by decoder logic 110 and decoded into samples that are stored in the frame buffer 120. The audio signal may be received from any input source, including a network. The time compression logic 130 may then compress a number of samples obtained from the frame buffer 120, using embodiments of the adaptive time compression techniques described below, and produce samples of output audio data that may be played out for the listener. The decoder logic 110, frame buffer 120, and time compression logic 130 may be implemented in hardware, including memory and processing logic elements, firmware, software, or any mixture of hardware, firmware, and software as desired. The apparatus 100 is generally part of an audio-processing apparatus, such as an endpoint or a multipoint control unit of a videoconferencing system, or a telephone system.

Figure 2:
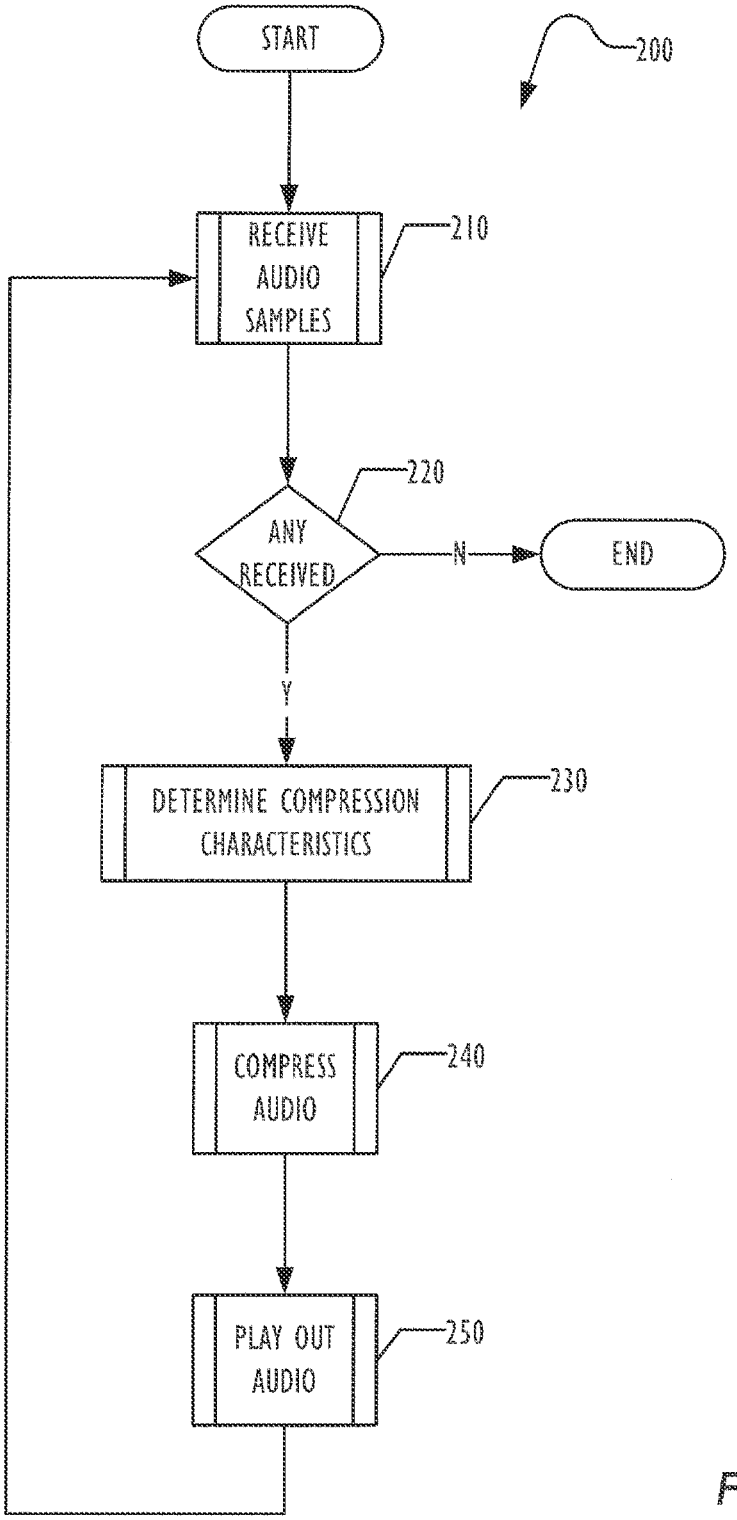
FIG. 2 is a flowchart illustrating a technique for reducing artifacts in time-compressed audio according to one embodiment.

FIG. 2 is a flowchart illustrating a technique 200 for reducing artifacts in time-compressed audio according to one embodiment that may be implemented in the time compression logic 130 of the apparatus 100. In block 210, audio samples may be received by apparatus 100 and stored in frame buffer 120. In block 220, if no audio samples were received, then the technique ends. In block 230, various characteristics are calculated corresponding to adaptive time compression technique described in more detail below. In block 240, time compression is performed on the samples in the frame buffer 120, according to the characteristics determined in block 230. In block 250, audio is played out from the frame buffer 120, and then the procedure iterates, starting with receiving additional samples in block 210. One should recognize that playing out audio from the frame buffer 120 may be implemented by outputting the audio to additional logic, not illustrated in FIG. 1, that may perform other processing techniques on the audio before the audio is actually heard by a human listener.

In speech-based audio, there are three dominant states: silence, voiced-speech, and unvoiced-speech. In one embodiment, to meet artifact and compression rate goals, each speech state may be processed differently. For example, sections of silence may be removed, voiced-speech may be shortened by increments synchronized to a pitch period of the audio, and white unvoiced-speech may be shortened more aggressively without synchronization.

To differentiate between these three speech states, measures such as signal-to-noise ratio (SNR), correlation, and whiteness may be employed, as described in more detail below.

One conventional time compression technique uses what is known as an Overlap-And-Add (OLA) approach. This is a time domain method of compression. The amount to be shortened is determined by the length of overlap of two portions of audio. The audio signal is cut into two segments, the segments are overlapped, and the segments are "added" together to produce a time-compressed audio signal. A common technique is to take two consecutive 10 ms frames of audio, and completely overlap them, shortening the audio play out by the 10 ms overlap length.

A better approach known to the art is Synchronized OLA (SOLA), in which the segments are synchronized to some measured factor, such as the pitch of a speaker's voice or another sound, and the frames are slid across each other until a maximum correlation is achieved at the overlap point. SOLA techniques typically overlay by an integer number of pitch periods, to avoid phase jump artifacts.

A third approach known to the art is known as silence removal. While both OLA and SOLA techniques may generate artifacts in the overlapped and added audio, silence removal avoids artifacts by simply removing or shortening periods of silence.

A desired approach to time compression generally balances the amount of compression achieved with a number of artifacts generated in the resulting audio.

Time compression using OLA and SOLA techniques cuts an audio signal into two segments. For example, let x be an array of N samples of an audio signal, stored in memory, where the oldest sample available in memory is designated x[1] and the newest sample in memory is designated x[N]. In such embodiments, N represents small time periods from around 10 ms to as much as a few hundred milliseconds.

Now cut the signal into two segments by defining a cut point c. Let x[1] through x[c] be the older segment and let x[c+1] through x[N] be the newer segment for a given cut value c. OLA techniques shift the newer segment back in time so that the two segments overlap by a length of L. In an OLA technique, L is always ½ N; in a SOLA technique, L may be other values, depending on the synchronization. The embodiments below generally provide a way to optimize the value of L so that artifacts are avoided.

In the overlap region, the two segments are merged or added together, typically using a weighted addition, such as is described below. The result is an output signal sample array y that is L−1 samples shorter than x[N].

To get time compression of more than L−1 samples, the technique may be performed iteratively, so that some samples of the array y from a prior iteration can be used as part of the array x for a new iteration. From iteration to iteration, the size of N may be a function of the number of the samples fed-back from the array y, the number of new audio samples received from the input source, and the play-out frame rate. In this iterative embodiment, the array x may contain both new samples and samples from previous iterations of the overlapping technique.

If the audio signal is received at a rate of 1600 samples per second, then a 10 ms frame has 160 samples, thus generally leading to a value of N of 160, since the system keeps at least one frame of audio in memory. However, if the signal is bursty, so that the 10 ms frame has 3200 or 4800 samples per second, for example, then N may be 320 or 480. Consider a situation where N=320. If the system is able to compress out only 100 samples of the 320 original samples, leaving 220 samples, and plays out 160 samples during one iteration, then 60 samples may be left over for the next iteration, so that even if 160 newly received samples are buffered in memory, the total number of buffered samples in memory may be 220.

In one embodiment, instead of cutting the buffered samples into two pieces and overlapping them, the buffered samples may be cut into a larger number of pieces, each of which is then overlapped with the preceding piece. In such an embodiment, N may not be the all of the samples stored in memory, but is simply the number of samples used for determining the overlap of any given iteration. For example, if the buffer is divided into three equal pieces, then N may take the value of the number of samples in the first ⅔ of the buffer.

As described in more detail below, the disclosed techniques attempt to optimize the values of c and L before performing OLA. Various embodiments may trade-off competing aspects, such as minimizing computational complexity, maximizing the time compression, minimizing overall algorithmic delay, and minimizing audio artifacts. Various embodiments described below define some threshold values that may be tuned for best audio quality, including a maximum overlap length Lmax, a low SNR Threshold, a high SNR Threshold, and a white Threshold.

Figure 3:
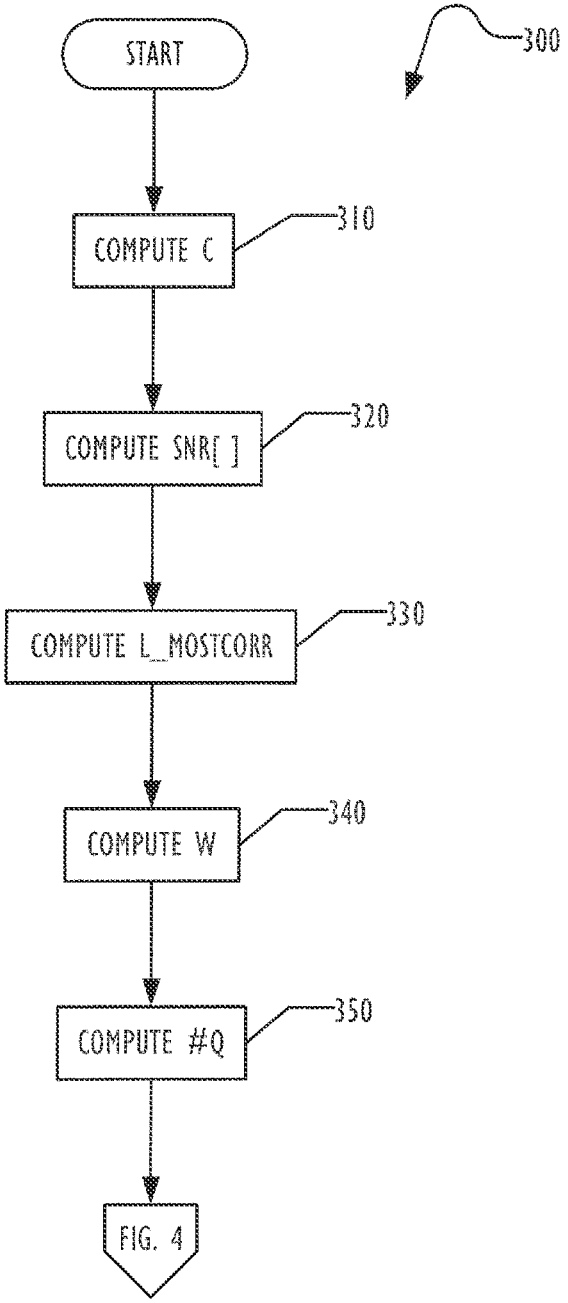
FIG. 3 is a flowchart illustrating a portion of a technique for determining compression characteristics for use in reducing artifacts in time-compressed audio according to one embodiment.

FIG. 3 is a flowchart illustrating a portion of a technique 300 for determining compression characteristics for use in reducing artifacts in time-compressed audio according to one embodiment. In this embodiment, the computation of L may be based on computation of three metrics: SNR, whiteness, and a most correlated overlap length.

In one embodiment, the technique is run iteratively. That is, the actions performed by the technique are performed once per output frame. One or more frames of audio may be used as input to the technique, producing a single frame of output audio. The frame rate period may vary, but is typically in the range of 10 ms to 30 ms. At the beginning of the technique illustrated in FIG. 3, new audio samples have been received from the input source and placed in memory along with other samples that you may already be in memory, as described below in the array x, giving samples x[1] through x[N].

In block 310, a value for c is computed. A simple computation for c would be $$c=L=\text{floor}(N/2)$$

However, such a simple application for c would result in artifacts when the time-compression technique is used iteratively. For example, assume that a subset of the samples x[1] through x[D] have already been in the overlap region of a prior time-compression iteration. Compressing those samples again is likely to introduce undesirable artifacts. To minimize artifacts on the current iteration, the overlap should only be done on samples x[D+1] through x[N]. Therefore a better version of c would be $$c=D+\text{floor}((N-D)/2)$$

In addition, experience shows that the overlap regions tend to yield artifacts. Therefore, in one embodiment an additional constraint may be placed on c by using a tuned maximum overlap length Lmax, as follows:

$$c=\text{Min}(D+\text{floor}((N-2)/2),D+L\text{max})$$

In one embodiment, the Lmax value may be tuned to a maximum pitch expected in the audio. For speech audio, the Lmax value may be tuned based on a maximum pitch of a speaker's voice, and may be experimentally chosen, by an implementer sampling audio to determine a maximum pitch of the speaking voice of any person.

In block 320, an array of values SNR[n] may be computed as a measure of a signal-to-noise ratio across the samples in the array x.

In block 330, the technique may compute a value for L_MostCorr. The newer of the two OLA segments is to be slid back by some distance L, creating an overlap region with the older segment. The technique searches all possible overlap lengths, and L_MostCorr should be chosen the one that creates the highest correlation between the older segment and the newer segment. Although SOLA techniques use a similar approach to determining a most synchronized overlap of the segments, in SOLA the maximum testable L_MostCorr is c. In one embodiment, correlations may be tested beyond c, meaning that the newer segment will overhang beyond x[1] in the correlation computation. Such a technique helps prevent false pitch detection.

Preferably, the correlation computation determines an actual dominant pitch in the room, and L_MostCorr should be tested beyond the overlap range. For example, if the testing for maximum correlation only went back as far as a maximum human pitch period and found a peak, deciding that the peak represented a dominant pitch in a room with the speaker, such a testing might overlook external sound sources, such as thunder going on outside the room. Thus, the computation might be selecting correlations based on something not really dominant in the room. Although in the thunder example the low frequency of the thunder itself may be out of range, harmonic frequencies may be within the range that are considered in this computation.

In block 340, an array of correlations may be calculated across the entire set of samples in memory, for use in computing a whiteness value W. If the ratio between the highest correlation and the lowest correlation is not large, then the samples may be considered relatively white and the largest correlation may not be considered very meaningful. Thus in one embodiment, the value for W may be computed as a ratio between the correlation at the L_MostCorr sample and the lowest correlation at all other tested L values.

In block 350, a number of quiet samples #Q may be computed. In one embodiment, this value may be computed by computing a number of quiet samples in each of two portions of the array x as follows. A first number of quiet samples may be calculated as the maximum value of #Q1 such that $$\text{SNR}[c+\#Q1+1] \text{ through } \text{SNR}[c]<LT$$

A second number of quiet samples may be calculated as the maximum value of #Q2 such that $$\text{SNR}[c+1] \text{ through } \text{SNR}[c+\#Q2]<LT$$

The number of quiet samples #Q may then be calculated as $$\text{Max}(\#Q1,\#Q2)$$

In one embodiment, the low SNR Threshold value LT and a corresponding high SNR Threshold value HT may be experimentally determined using listening tests. These thresholds are defined so that samples below the low SNR Threshold value are probably quiet, samples above the high SNR Threshold value are definitely not quiet, and samples in between those two thresholds are uncertain. In one embodiment, the low SNR Threshold value LT and the high SNR Threshold value HT are tuned based on what produces the least artifacts in the time-compressed audio.

Figure 4:
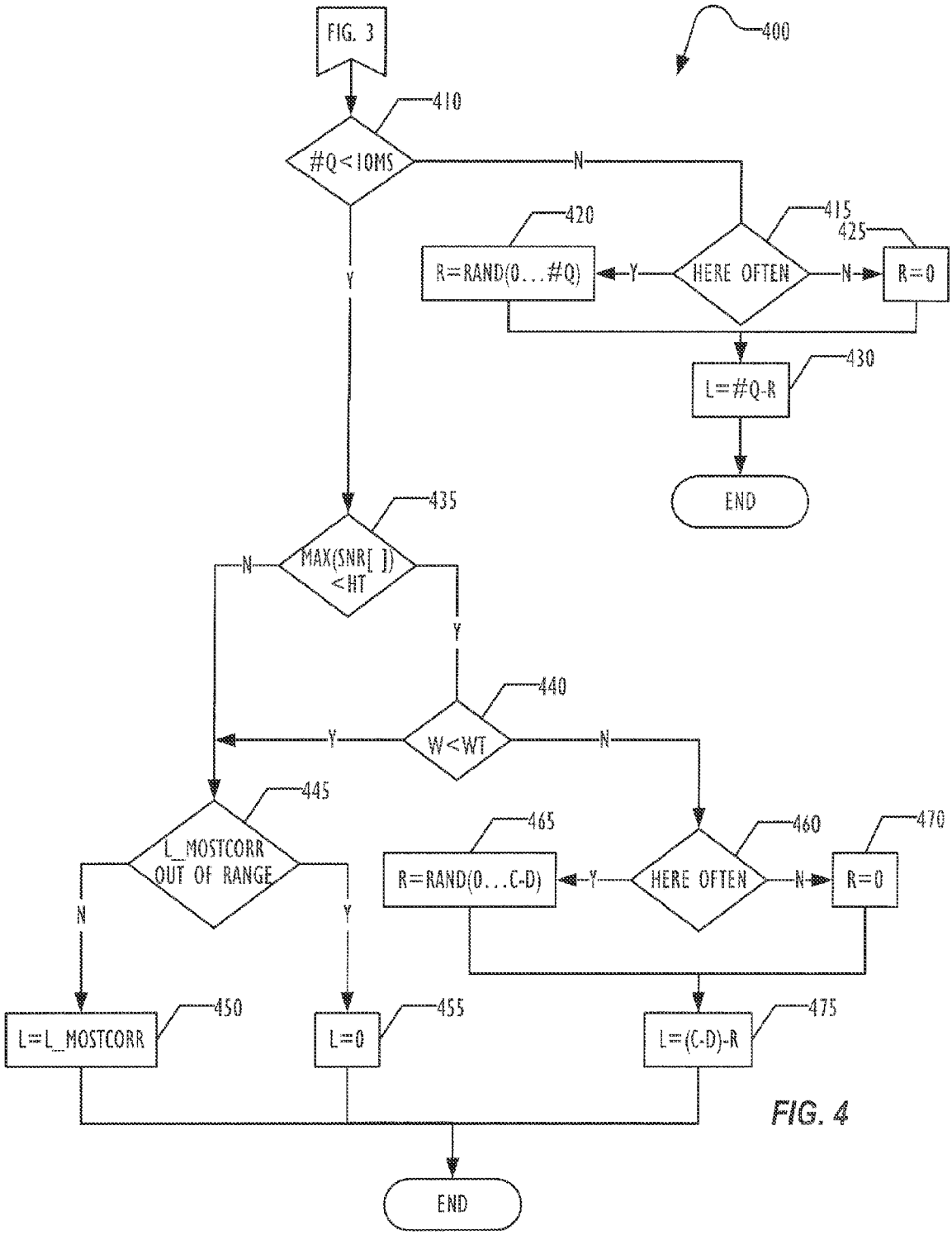
FIG. 4 is a flowchart illustrating another portion of a technique for determining compression characteristics for use in reducing artifacts in time-compressed audio according to one embodiment.

FIG. 4 is a flowchart of a second portion of the technique 400 that uses the values computed in FIG. 3 to determine compression characteristics to control the time-compression technique to reduce number of artifacts in the output audio. In block 410, continuing on from the portion illustrated in FIG. 3, the number of quiet samples value computed in block 350 is used to determine how much silence should be used for determining the length of the overlap. In the example embodiment illustrated in FIG. 4, if more than 10 ms of silence is present, then the value of L is computed to allow compression out of the silent period. The threshold of 10 ms illustrative and by way of example only, and other threshold values for comparing with the number of quiet samples #Q may be used as desired. To avoid performing time compression on silent portions in a way that introduces periodicity into the audio that may be heard by a listener, a random value may be used to adjust the number of quiet samples value #Q when computing the value L.

Blocks 415 through 430 illustrate one embodiment of adjusting the value L with a random number. In block 415, if this block is reached frequently, such that periodicity might be introduced into the audio, then in block 420 the value R may be computed as a random number between 0 and the number of quiet samples #Q. otherwise, the value are may be set to 0 in block 425. In block 430, the overlap value L is calculated as follows:

$$L=\#Q-R$$

The second portion of the technique 400 then completes, allowing the calculated value of L to be used for the actual compression of block 240 of FIG. 2. In one embodiment, the determination in block 415 may be based upon having compressed silence in 10 consecutive iterations of the technique. In alternate embodiments, the determination in block 415 may be based on having compressed silence a predetermined number of iterations in a group of iterations, regardless of how many of the iterations were consecutive. Thus, for example, in one embodiment the determination in block 415 may be based upon having compressed silence during any 10 iterations of the past 15 iterations, without consideration of how many of those were consecutive iterations. The predetermined threshold value of block 415 may therefore be considered a threshold number of audio frames in a recent period that contain silence.

If the number of quiet samples #Q is less than the predetermined threshold as determined in block 410, then the audio may be considered to contain speech or other non-quiet sound. For such audio, in block 435 a determination is made of whether the maximum value of signal-to-noise ratio data stored in the SNR array is less than the high SNR Threshold value HT.

If so, then in block 440 the whiteness of the audio data is compared to the whiteness threshold value WT. An implementer may determine the whiteness threshold WT by listening tests.

If the signal-to-noise ratio is above the high SNR Threshold value HT or the audio data has a whiteness less than the whiteness threshold value WT, then the L_MostCorr value may be used to determine the overlap amount L in blocks 445 through 455. Otherwise, the correlation information may be considered of too little value to be used, and the value L may be computed in block 460 through 475 from the values C and D that were determined as described in block 310 above. Thus, unlike previous techniques, midrange correlated audio data that is considered white (e.g., unvoiced speech) may be treated similar to silent periods such as the techniques described in blocks 415 through 430 above. The use of the whiteness computations allows distinguishing unvoiced speech from voiced speech, and treating unvoiced speech similar to silence.

If the L_MostCorr value is to be used, then in block 445, the L_MostCorr value is checked to ensure that it is not too large or too small for quality overlap and add time compression. Thus if the L_MostCorr value is greater than (c−D), the value is too large, because it would compress audio data that was compressed in the previous iteration. If the L_MostCorr value is less than a predetermined minimum most correlated overlap length threshold value, then the overlap region may be considered too small to have a smooth overlap and add without artifacts. The minimum L_MostCorr value threshold may be selected as desired; in one embodiment, the threshold value is experimentally determined by listening tests. If the L_MostCorr value is usable, then the overlap amount L is set to the L_MostCorr value in block 450; otherwise, no overlap is feasible and the overlap amount L is set to 0 in block 455.

If instead of using the L_MostCorr value, because the relatively white audio is to be treated as if it were silent, then in blocks 460 through 475 a frequency of the event approach is used similar to the whiteness randomization described above in blocks 415 through 430.

In block 460, if the audio is considered white in too many iterations of the technique, then a random value may be used to avoid artifacts that would otherwise be generated from overlapping to frame boundaries. As in the randomization of blocks 415 through 430, in various embodiments a threshold value for "too many iterations" may be predetermined as a number of consecutive iterations, for example 10 consecutive iterations, or may be predetermined as a number of recent iterations, regardless of consecutiveness, such as 10 of the last 15 iterations. The threshold value may be considered as a threshold number of audio frames in a recent period that contain unvoiced speech. If a randomization is to be performed, then in block 465 a random number R is calculated as a random number between 0 and c−D; otherwise, in block 470 the value R is set to 0. Then in block 475, the overlap amount L is calculated as $$L=(c-D)-R$$

Figure 5:
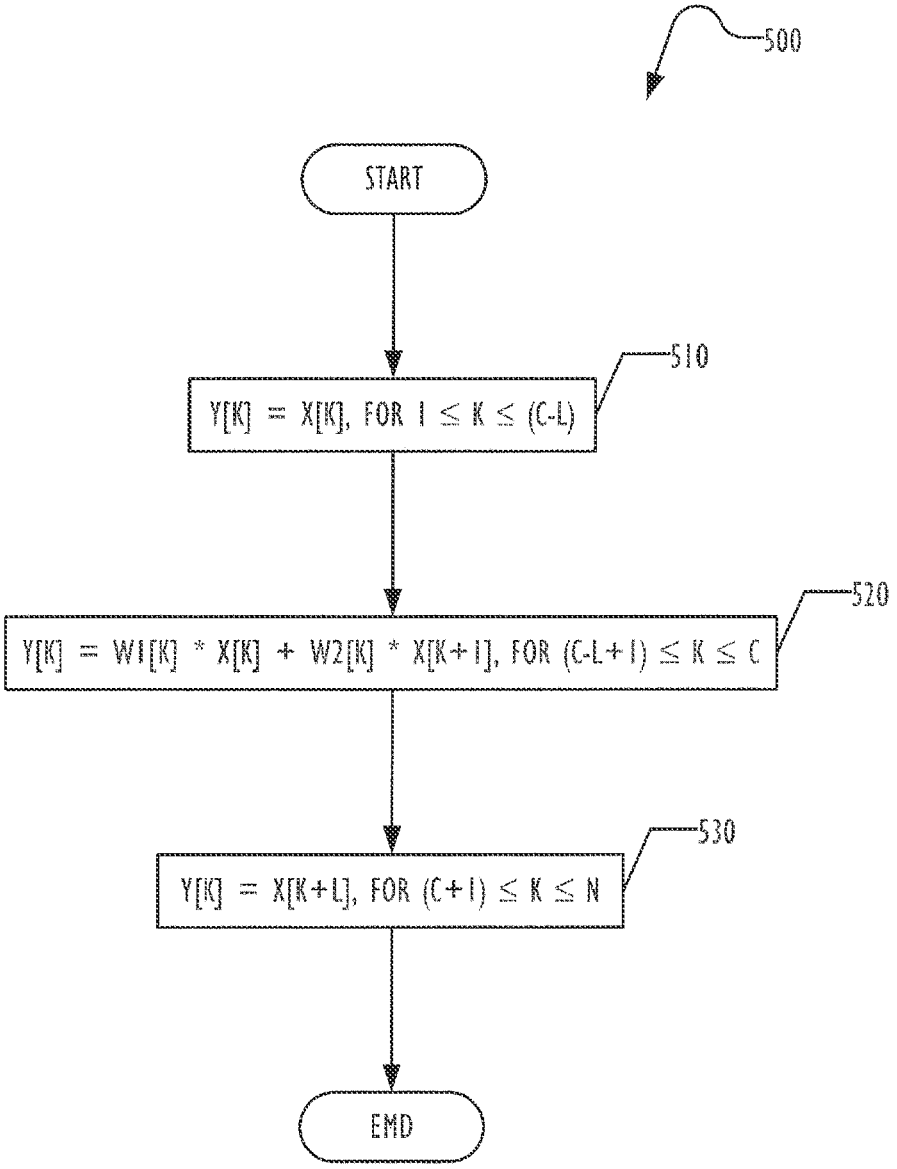
FIG. 5 is a flowchart illustrating a technique for time-compressing audio using compression characteristics determined according to the technique of FIGS. 3 and 4, according to one embodiment.

Once the overlap amount L is calculated, then the overlap and add compression of block 240 may be performed. FIG. 5 is a flowchart of a technique 500 for performing the OLA compression using the values c and L.

In block 510, and output array y is created from the input audio array x for the portion prior to the overlap. Thus, $$y[k]=x[k]$$

for values of k between 1 and (c-L).

In block 530, the portion beyond the overlap region is also copied into the array y:

$$y[k]=x[k+L]$$

for values of k between c+1 and N.

In block 520, the actual overlap is performed, for values of k between (c-L+1) and c. In one embodiment, functions w1 and w2 are used to weight the values of the corresponding x array values. In one embodiment, the function w1 is implemented as an audio fade out and the function w2 is implemented as an audio fade in. Thus, the output audio array y starts out the same as the input audio array x and in the same as the input audio array x, but during the middle samples, a listener would hear the first segment of the input array x fade out as the second segment fades in. The result is that the audio sequence of N samples is compressed to a sequence of (N-(L−1) samples.

The use of fade in and fade out functions w1 and w2 is illustrative and by way of example only. In other embodiments, other types of functions w1 and w2 may be used, including ones that simply switch the audio output from the older segment to the newer segment without any type of fade in/out.

Figure 6:
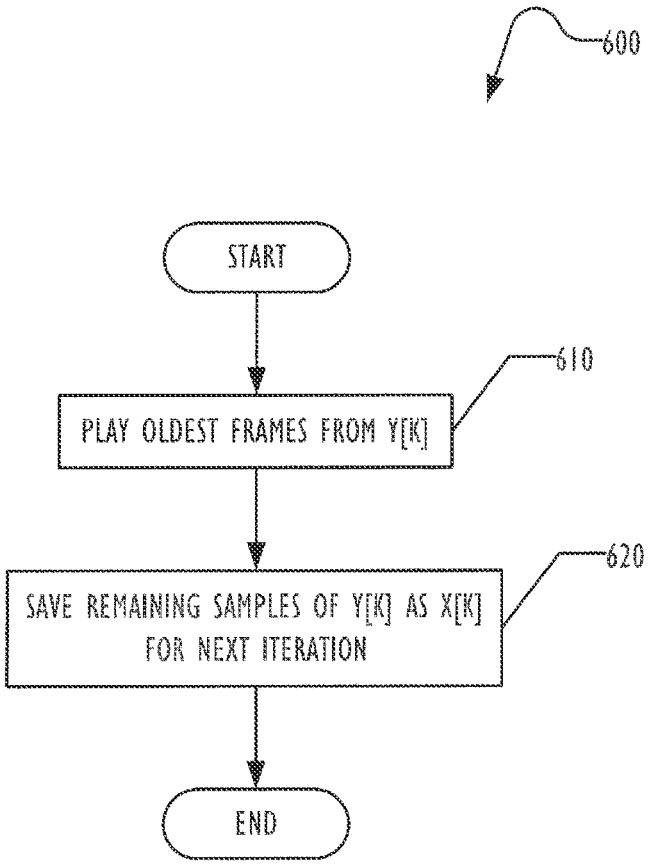
FIG. 6 is a flowchart illustrating a technique for playing time-compressed audio according to one embodiment.

The output audio array y may then be processed further or sent to the playback mechanism of the apparatus 100. FIG. 6 is a flowchart illustrating a technique 600 for playing back the oldest frames from the output array y, and setting up for a next-generation of the time compression technique. In block 610, the oldest frames from the output array y may be sent for playback. Then in block 620, the remaining samples of the output array y are placed into the input array x for the next iteration as the oldest samples, to be followed by new samples received from the input source.

Unlike the conventional techniques, that attempt to mitigate audio artifacts by lowering the rate of compression, resulting in a loss of efficiency, the techniques described herein mitigate audio artifacts by adapting the rate of compression where necessary, allowing higher compression rates while preserving a low level of artifacts. Thus, the techniques described above, may allow more efficient time compression while maintaining or improving audio quality.

Some embodiments of the disclosed techniques ensure that true pitch phase is maintained, avoiding synchronization to a false pitch frequency that may result in rough artifacts. By tracking the status of the audio and adapting compression parameters, various embodiments may minimize artifacts while maximizing compression. By using a randomized approach to eliminating long period of silence or unvoiced speech, some embodiment may reduce unnatural artifacts that can be generated by removing blocks of audio from such long silent periods. This may be particularly valuable in a conferencing situation, where one direction of the audio may have long periods of silence.

By allowing for compression where feasible, but skipping compression where compression would lead to an artifact, compression may be concentrated in sections of audio where the processing can be masked. Thus, various embodiments of the apparatus and techniques described above provide a better listening experience for the user, particularly in conferencing environments.

It is to be understood that the above description is intended to be illustrative, and not restrictive. For example, the above-described embodiments may be used in combination with each other. Many other embodiments will be apparent to those of skill in the art upon reviewing the above description. The scope of the invention therefore should be determined with reference to the appended claims, along with the full scope of equivalents to which such claims are entitled. In the appended claims, the terms "including" and "in which" are used as the plain-English equivalents of the respective terms "comprising" and "wherein."

What is claimed is:

1. A method of time-compressing audio data, comprising:

receiving audio data and storing the audio data in a frame buffer of an audio-processing apparatus;

selecting a cut point in the audio data by the audio-processing apparatus, separating a first segment of the audio data and a second segment of the audio data, wherein the cut point is selected to prevent audio data compressed in a first iteration of the method from being compressed in a second iteration of the method, and wherein the cut point defines the second segment to have a length no greater a maximum overlap length value;

calculating an overlap length of the first segment and the second segment, responsive to characteristics of the audio data; and overlapping by a time compression logic of the audio-processing apparatus the overlap length of the second segment on the first segment, generating an output audio data, wherein the overlap length is randomly reduced if the audio data comprises unvoiced speech or silence for more than a threshold number of audio frames.

2. The method of claim 1, further comprising:

determining the maximum overlap length value responsive to a maximum pitch expected in the audio data.

3. The method of claim 1, wherein the zero is a valid overlap length value.

4. The method of claim 1, wherein the act of calculating an overlap length of the first segment and the second segment responsive to characteristics of the audio data comprises:

calculating a number of quiet samples in the audio data; and calculating the overlap length responsive to the number of quiet samples.

5. The method of claim 4, wherein the act of calculating the overlap length responsive to the number of quiet samples comprises:

calculating the overlap length by subtracting a random number from the number of quiet samples.

6. The method of claim 1, wherein the act of calculating an overlap length of the first segment and the second segment responsive to characteristics of the audio data comprises:

distinguishing unvoiced speech from voiced speech in the audio data; and calculating the overlap length based on the length of the second segment if the audio data contains unvoiced speech.

7. The method of claim 6, wherein the act of calculating the overlap length based on the length of the second segment comprises:

calculating the overlap length by subtracting a random number from the length of the second segment.

8. The method of claim 1, wherein the act of calculating an overlap length of the first segment and the second segment responsive to characteristics of the audio data comprises:

calculating a most correlated overlap length, wherein the most correlated overlap length is allowed to exceed the length of the first segment.

9. The method of claim 8, wherein the act of calculating an overlap length of the first segment and the second segment responsive to characteristics of the audio data further comprises:

calculating the overlap length as 0 if the most correlated overlap length is greater than the length of the first segment.

10. The method of claim 8, wherein the act of calculating an overlap length of the first segment and the second segment responsive to characteristics of the audio data further comprises:

calculating the overlap length as 0 if the most correlated overlap length is less than a predetermined minimum most correlated overlap length.

11. The method of claim 1, wherein the act of calculating an overlap length of the first segment and the second segment, responsive to characteristics of the audio data comprises:

calculating a whiteness value of the audio data.

12. The method of claim 1, wherein the act of calculating an overlap length of the first segment and the second segment, responsive to characteristics of the audio data comprises:

calculating a number of quiet samples in the audio data.

13. The method of claim 1, wherein the act of calculating an overlap length of the first segment and the second segment, responsive to characteristics of the audio data comprises:

calculating signal-to-noise ratio data for the audio data.

14. An apparatus, comprising:

a decoder logic configured to decode a received audio signal and to generate an audio data;

a hardware frame buffer for storing the audio data; and a time-compression logic configured to time-compress audio data obtained from the frame buffer, comprising:

logic configured to select a cut point in the audio data separating a first segment of the audio data and a second segment of the audio data, wherein the cut point is selected to prevent audio data compressed in a first compression iteration from being compressed in a second compression iteration, and wherein the cut point defines the second segment to have a length no greater a maximum overlap length value;

logic configured to calculate an overlap length of the first segment and the second segment, responsive to characteristics of the audio data; and logic configured to overlap and add the overlap length of the second segment on the first segment, generating an output audio data, wherein the overlap length calculation logic randomly reduces the overlap length if the audio data comprises unvoiced speech or silence for more than a threshold number of audio frames.

15. The apparatus of claim 14, wherein the apparatus is a videoconferencing endpoint.

16. The apparatus of claim 14, wherein the apparatus is a multipoint control unit of a videoconferencing system.

17. The apparatus of claim 14, wherein the apparatus is a telephone.

18. The apparatus of claim 14, wherein the overlap length is allowed to be zero.

19. The apparatus of claim 14, wherein the overlap length calculation logic calculates the overlap length differently responsive to whether the audio data comprises voiced speech, unvoiced speech, or silence.

* * * * *